US007580536B2

(12) United States Patent
Carlile et al.

(10) Patent No.: US 7,580,536 B2
(45) Date of Patent: Aug. 25, 2009

(54) SOUND ENHANCEMENT FOR HEARING-IMPAIRED LISTENERS

(75) Inventors: Simon Carlile, Haberfield (AU); Craig Jin, Heathcote (AU); Johahn Leung, Pyrmont (AU); Andre Van Schaik, Annandale (AU)

(73) Assignee: Vast Audio Pty Ltd. (AU)

( * ) Notice: Subject to any disclaimer, the term of this patent is extended or adjusted under 35 U.S.C. 154(b) by 516 days.

(21) Appl. No.: 10/566,663

(22) PCT Filed: Aug. 10, 2004

(86) PCT No.: PCT/AU2004/001068

§ 371 (c)(1),
(2), (4) Date: Jan. 31, 2006

(87) PCT Pub. No.: WO2005/015952

PCT Pub. Date: Feb. 17, 2005

(65) Prior Publication Data

US 2007/0127748 A1 Jun. 7, 2007

(30) Foreign Application Priority Data

Aug. 11, 2003 (AU) ..... 2003904207

(51) Int. Cl.
*H04R 25/00* (2006.01)

(52) U.S. Cl. ..... 381/316; 381/320

(58) Field of Classification Search ..... 381/312, 381/316, 320, 328, 330

See application file for complete search history.

(56) References Cited

U.S. PATENT DOCUMENTS

| | | | | |
|---|---|---|---|---|
| 4,837,832 | A | 6/1989 | Fanshel | |
| 5,144,675 | A * | 9/1992 | Killion et al. | 381/321 |
| 2003/0072464 | A1 * | 4/2003 | Kates | 381/312 |
| 2004/0175010 | A1 * | 9/2004 | Allegro et al. | 381/316 |

FOREIGN PATENT DOCUMENTS

| | | |
|---|---|---|
| WO | WO 85/02085 | 5/1985 |
| WO | WO 99/14986 | 3/1999 |
| WO | WO 01/26418 | 4/2001 |
| WO | WO 01/54453 | 7/2001 |
| WO | WO 2005/004534 | 1/2005 |

* cited by examiner

*Primary Examiner*—Brian Ensey
(74) *Attorney, Agent, or Firm*—Greenberg Traurig, LLP

(57) ABSTRACT

A method of enhancing sound heard by a hearing-impaired listener comprises monitoring the sound in an environment in which the listener is located; and manipulating the frequency of high frequency components of the sound in a high frequency band, with little, if any, distortion to components of the sound in a speech frequency band, to enhance spectral cues to aid the listener in sound externalisation and spatialisation.

32 Claims, 8 Drawing Sheets

SOUND ENHANCEMENT FOR HEARING-IMPAIRED LISTENERS

FIELD OF THE INVENTION

This invention relates to sound enhancement for hearing-impaired listeners. More particularly, the invention relates to a method of, and equipment for, enhancing sound heard by hearing-impaired listeners.

BACKGROUND TO THE INVENTION

A listener wearing a conventional hearing-aid demonstrates a substantial reduction in his or her sound externalisation and sound spatialisation abilities and this, in turn, significantly reduces the listener's ability to parse sounds of interest from competing background sounds. On the other hand, a non-hearing impaired listener relies on spatial hearing to separate competing sounds based on the different spatial locations between the sources of the sounds and the listener. Sound spatialisation also assists listeners to focus attention on sounds of interest.

Human spatial hearing relies on the integration of acoustic information from both ears. This acoustic information consists of the binaural difference in the intensity and time of arrival of sound between the two ears and also the monaural spectral cues that result from the location-dependent acoustic filtering of sound by the outer ear. The perception of externalised sounds (i.e., sounds that are heard as outside of the head) relies primarily on the monaural spectral cues provided by the acoustic filtering of the outer ear. Sounds without these spectral cues, but with a consistent interaural time difference cue and interaural intensity difference cue, are perceived as lateralised and inside of the head.

A hearing-impaired listener usually suffers greater hearing loss at higher frequencies. However, due to the shape and size of the outer ear, the frequency range over which the monaural spectral cues play an important role for spatial acuity is generally from about 5 kHz to 20 kHz, which is in the higher range of auditory frequencies. As a result, auditory spatialisation is significantly impaired for the hearing-impaired listener, which ultimately leads to the inability to separate information from background noise. Furthermore, it is the high frequencies above about 8 kHz that are required for accurate spatialisation of speech stimuli.

Various methods for enhancing the spatial hearing of listeners wearing hearing aids have been proposed. One of these methods for enhancing the spatial hearing of listeners wearing hearing aids involves the use of miniature, completely-in-the-canal (CIC) hearing aids to avoid interference with the acoustic filtering of the outer ear. The electronics for the CIC hearing-aids are contained within a small mould that is completely contained within the auditory canal.

Another method for enhancing the spatial hearing of listeners wearing hearing aids involves the use of open or non-occluding ear moulds that do not distort the low-frequency interaural time difference cues.

Yet another method for enhancing the spatial hearing of listeners wearing hearing aids involves adjusting the gains of the left and right hearing aids based on empirical localisation tests in an attempt to preserve the interaural intensity difference cues.

One disadvantage of all of these methods is that they do not use signal processing to enhance and provide high-frequency monaural spectral cues that vary consistently with the location of the sound in space.

Another disadvantage of all of these methods is that they do not make the very high frequency spectral cues (greater than about 8 kHz) more audible.

Terms related to this invention are defined below:

The term "speech frequency band" is the frequency range (approximately, but not exactly, 200 Hz to 4 kHz) that is empirically most important for a listener's speech perception. It may vary slightly from listener to listener and may be determined empirically and/or analytically.

The term "high-frequency band" refers to the frequency band above the speech frequency band.

The term "high frequency component" refers to a frequency component of a sound that occurs in the high frequency band.

SUMMARY OF THE INVENTION

According to a first aspect of the invention, there is provided a method of enhancing sound heard by a hearing-impaired listener, the method comprising monitoring the sound in an environment in which the listener is located; and manipulating the frequency of high frequency components of the sound in a high frequency band, with little, if any, distortion to components of the sound in a speech frequency band, to enhance spectral cues to aid the listener in sound externalisation and spatialisation.

The method may include manipulating the frequency of the high frequency components by a technique selected from the group comprising: compressing the components across a frequency range, shifting the high frequency components to lower frequencies and combinations of the foregoing.

The method may include dividing the sound into a number of segments in time;

determining whether or not there are high frequency components of the sound in each of the segments; and manipulating the frequency of the high frequency components only for segments in which there is an occurrence of high frequency energy above a predetermined threshold in the high frequency band.

Instead, the method may include dividing the sound into a number of segments in time;

determining whether or not the sound in each segment has a harmonic structure in the high frequency band; and manipulating the frequency of the high frequency components only for segments in which there is little, if any, harmonic structure in the high frequency band.

The method may be implemented in at least one hearing aid of the listener, the method further including configuring the hearing aid to preserve acoustic filtering of an outer ear of the listener.

Further, the method may include determining a hearing range for the listener and customising the manipulation of the high frequency components to the hearing range of the listener.

In one embodiment, the method may include manipulating the high frequency components by first transforming a sound signal to the frequency domain and, thereafter, modifying the frequency domain representation using one of a mapping and a warping technique.

In another embodiment of the invention, the method may include manipulating the high frequency components in the time-domain using at least one of a time-domain filter bank and a resampling technique to shift and/or compress the high frequency components to lower frequencies.

In the case of both embodiments, the mapping technique may include replacing frequency components in a range from $f_1$ to $f_2$ with frequency components in a second, lower range of $f_3$ to $f_4$ according to a mapping:

$$S\left(f_1 + (f - f_3)\frac{f_2 - f_1}{f_4 - f_3}\right) \rightarrow S(f), \text{ where } f_3 \le f \le f_4.$$

The method may include, when effecting the manipulation of the high frequency components, at least partially preserving a harmonic relationship between the components.

Further, the method may include manipulating the high frequency components using a logarithmic compression technique.

The method may include dividing the sound signal into a number of discrete frequency components and obtaining frequency components $f_i$ above the speech frequency band for an output signal according to a mapping:

$$S(f_{n*i+c}) \rightarrow S(f_i),$$

where n is a positive integer and c is a constant integer.

Instead, the method may include dividing the sound signal into a number of discrete frequency components and obtaining frequency components $f_i$ above the speech frequency band for an output signal according to a mapping:

$$S(f_{n*i+ci}) \rightarrow S(f_i),$$

where n is a positive integer and $c_i$ is adjusted for each i to select that frequency component with maximum energy out of frequency components $f_{n*i}$ to $f_{(n+1)*i-1}$.

In yet a further embodiment the method may include performing frequency transposition of the sound signal using a Laguerre transform.

Preferably, the method includes further manipulating the frequency of the high frequency components by signal amplification. Further, the method may include applying the signal amplification so as to maintain consistent relative gain across frequency for the high frequency components.

The method may be implemented using a hearing aid in each ear of the listener, the method including applying the signal amplification so as to maintain consistent relative gain between the two ears for the high frequency band of each ear.

The method may include changing the relative amplitude of each frequency component of the sound independently before and/or after manipulation of the high frequency components.

Further, the method may include enabling the listener to discontinue manipulation of the high frequency components.

In a development of the invention, the method may include receiving auxiliary audio signals to be rendered as virtual audio; and incorporating the auxiliary audio signals to produce an output audio signal including a virtual audio component.

The method may include processing the auxiliary audio signals using virtual audio space techniques to create an effect for the listener that the sound originate at specific locations in a personal auditory space around the listener's head. The virtual audio space techniques are described in greater detail in PCT/AU01/00038 filed 16 Jan. 2001 and entitled "The generation of customised three dimensional sound effects for individuals", the contents of which are incorporated herein by reference.

According to second aspect of the invention, there is provided equipment for enhancing sound heard by a hearing-impaired listener, the equipment comprising at least one hearing aid device comprising:

a housing to be associated with an ear of the listener;

a sensor associated with the housing for sensing the sound;

a delivery medium carried by the housing for delivering processed sound to an auditory system of the listener;

a primary signal processing arrangement contained within the housing, the primary signal processing arrangement being configured to perform conventional hearing aid signal processing; and an auxiliary signal processing arrangement in communication with the primary signal processing arrangement, the auxiliary signal processing arrangement being configured to manipulate the frequency of the high frequency components with little, if any, distortion to components of the sound in a speech frequency band to enhance spectral cues to aid the listener in sound externalisation and spatialisation.

The equipment may include a listener operable interface for enabling the listener to disable the auxiliary signal processing arrangement.

The equipment may include a discriminator in communication with the auxiliary signal processing arrangement, the discriminator discriminating between the frequencies of the components of the sounds and being operable to activate the auxiliary signal processing arrangement only for time windows in which there is an occurrence of high frequency energy above a predetermined threshold in the high frequency band.

The housing may be configured to minimally disrupt acoustic filtering of an outer ear of the listener.

The auxiliary signal processing arrangement may manipulate the high frequency components by at least one of compressing the high frequency components across a frequency range and shifting the high frequency to lower frequencies.

At least one of the primary signal processing arrangement and the auxiliary signal processing arrangement may be further operable to manipulate the high frequency components by signal amplification.

The auxiliary signal processing arrangement may be interposed between the primary signal processing arrangement and the sensor.

The equipment may include two hearing aid devices, one for each ear of the listener. The signal processing arrangements of each of the hearing aid devices may be operable to amplify the high frequency sound components so as to maintain consistent gain between the two ears of the listener for each high frequency band.

In a development of the invention, the equipment may include a communications receiver in communication with the primary signal processing arrangement, the receiver receiving auxiliary audio signals to be rendered as virtual audio to produce an output audio signal including a virtual audio component. Then, the primary processing arrangement may be operable to process the auxiliary audio signals using virtual audio space techniques to create an effect for the listener that the sound originates at specific locations in a personal auditory space around the listener's head.

BRIEF DESCRIPTION OF THE DRAWING

The invention is now described by way of example with reference to the accompanying drawings in which:—

DETAILED DESCRIPTION OF AN EXEMPLARY EMBODIMENTS

Figure 1:
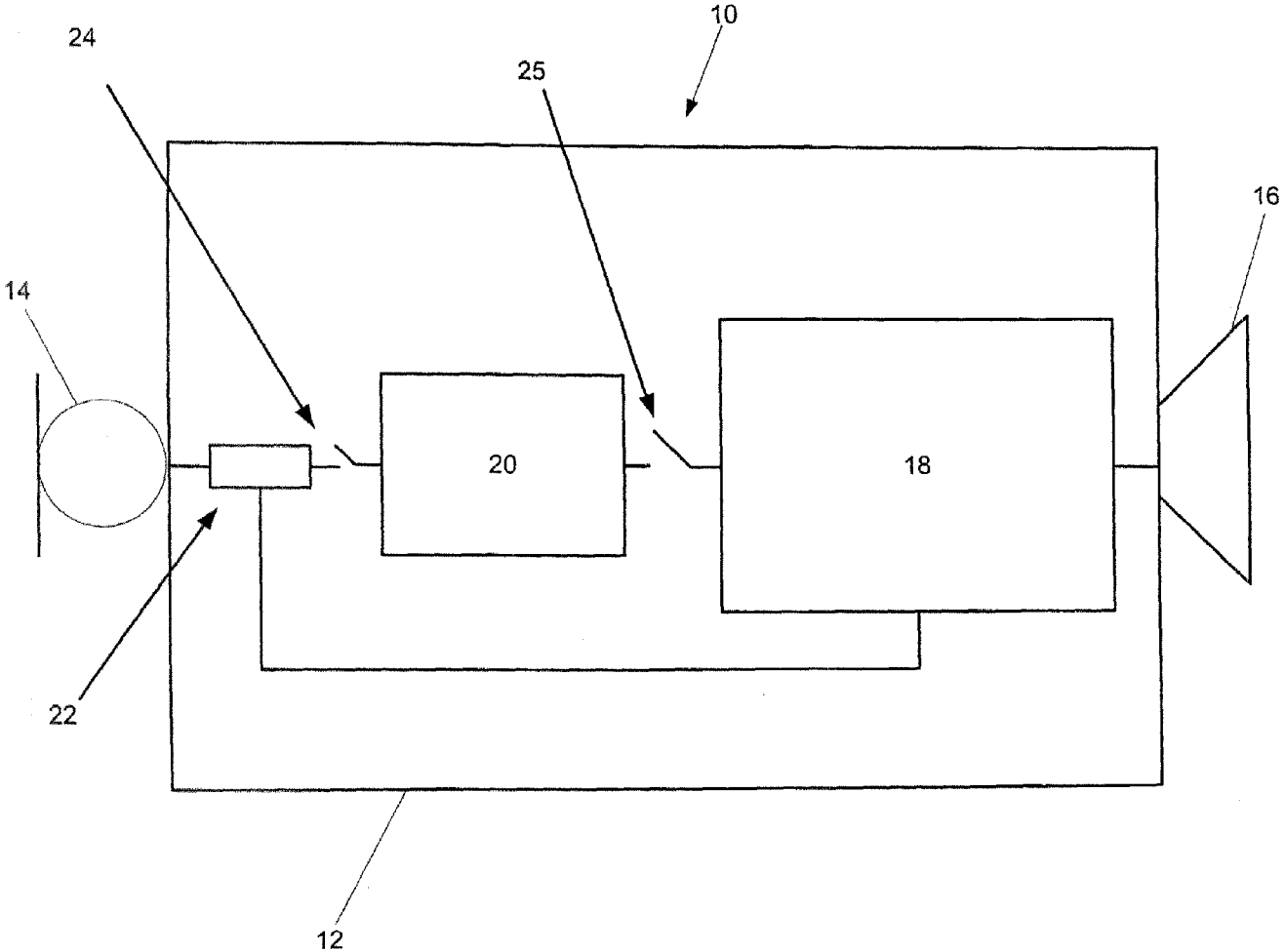
FIG. 1 shows a schematic block diagram of equipment, in accordance with an embodiment of the invention, for enhancing sound heard by a hearing-impaired listener.

In the drawings, reference numeral 10 generally designates equipment, in accordance with an embodiment of the invention, for enhancing sound heard by a hearing-impaired listener. The equipment 10 includes a housing 12 which houses hearing-aid electronics and components.

An acoustic sensor 14 is arranged on the housing for sensing acoustic signals. A sound delivery medium 16 is carried by the housing 12 and relays sound to the eardrum of a listener's ear carrying the equipment 10.

The components of the equipment 10 include a primary signal processor 18 which perform conventional hearing aid signal processing. An auxiliary signal processor 20 is interposed between the primary signal processor 18 and the sensor 14.

The auxiliary signal processor 20 is, optionally, controlled by a discriminator 22 which determines whether or not there are components of sound having a high energy frequency above a predetermined threshold in the high frequency band. In the preferred implementation of the invention though, the auxiliary signal processor 20 is operative always to do a frequency shift operation regardless of whether or not there are any high frequency sound components present. In this way, the need to detect the presence of the high frequency components above a certain threshold and, hence, the need for the discriminator is obviated.

In addition, externally accessible switches 24 and 25 are provided to enable the listener to deactivate the auxiliary signal processor 20. These switches are, optionally, controlled by the discriminator 22 to be deactivated when no high frequency sound components are present.

In a preferred implementation of the invention, the housing 12 is in the form of a completely-in-the-canal hearing aid housing to preserve acoustic filtering of an outer ear of the listener and, in so doing, to minimise adversely influencing monaural spectral cues provided by such acoustic filtering of the outer ear.

The sensor 14 is a broadband (20 Hz to 20 kHz) microphone. The sensor 14 converts incoming soundwaves into an electronic signal for onward transmission to the components of the equipment 10.

The auxiliary signal processor 20 is tailored to an individual listener's requirements by appropriate calibration so that, prior to use, the high frequency band applicable to that listener falls in the listener's optimal high frequency range.

The auxiliary signal processor 20 is operable to manipulate the sound component in the high frequency band. More particularly, the auxiliary signal processor 20 compresses the sound components across a frequency range and/or shifts the frequencies of the sound components in the high frequency baud to lower frequencies by means of the following mapping:

$$S\left(f_1 + (f - f_3)\frac{f_2 - f_1}{f_4 - f_3}\right) \rightarrow S(f), \text{ where } f_3 \le f \le f_4.$$

Figure 2:
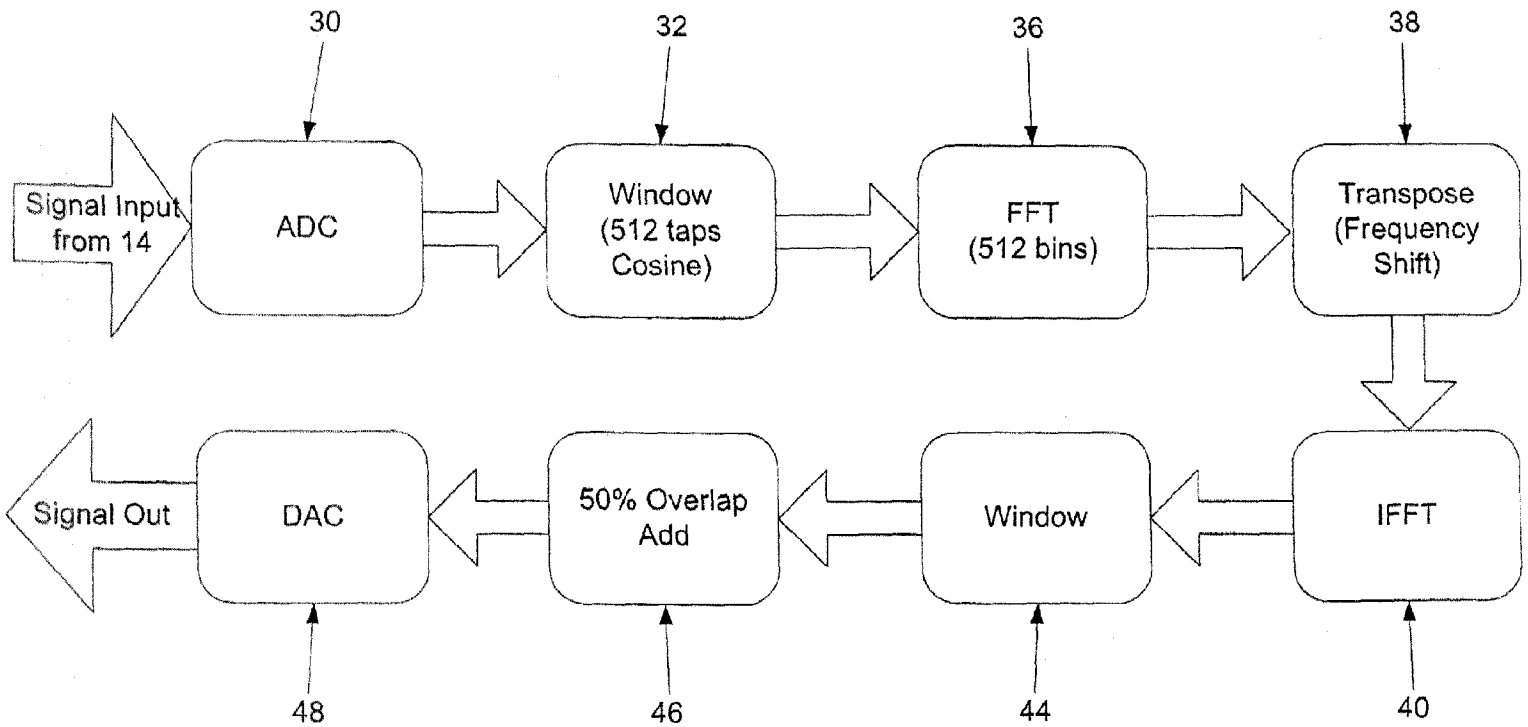
FIG. 2 shows a flow chart of a first embodiment of signal processing steps of an auxiliary signal processor of the equipment.
Figure 3:
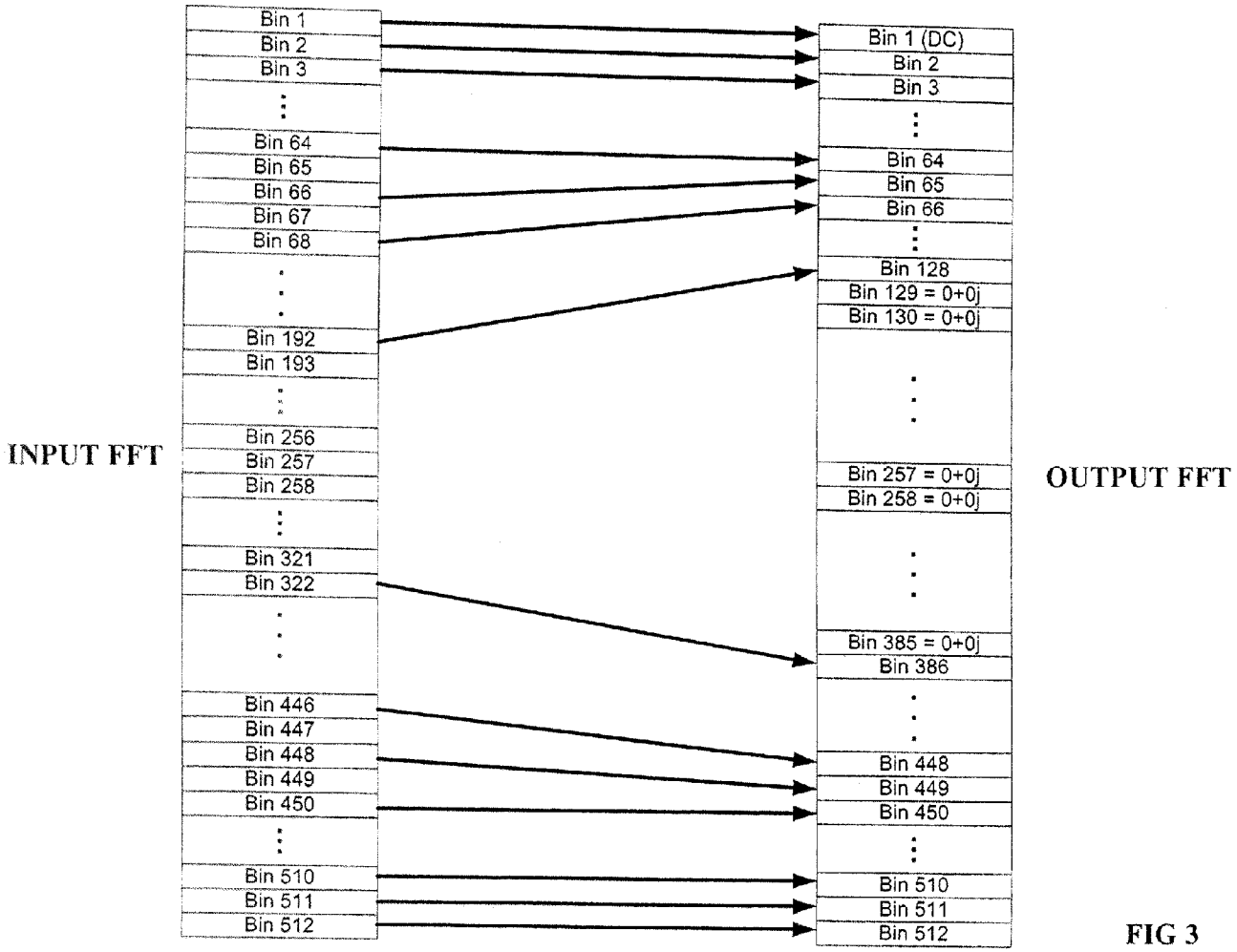
FIG. 3 shows one embodiment of a frequency transposition table for use in the auxiliary signal processor.

A block diagram of the processing operation of the auxiliary signal processor is shown in FIG. 2 of the drawings. A sampling Analogue to Digital Converter (ADC) 30 samples the input signal from the sensor 14 at a sample frequency of approximately 32 kHz and represents each sample as a 24-bit digital word. Every 256 samples, the following steps are performed:

at step 32, the 512 most recent samples are windowed with their respective windowing coefficients. The window used is a 512 taps Cosine window;

at step 34, the windowed data are transformed to the frequency domain using a 512 point Fast Fourier Transform (FFT). The outputs of the FFT are 512 frequency bins representing signal frequencies from DC (0 Hz) to 16 kHz with complex numbers;

at step 38, those frequency bins outside the speech frequency band are frequency shifted (transposed) by a transposition block. An example of such a transposition table is illustrated in FIG. 3 of the drawings. In FIG. 3, the first 64 and the last 63 bins in the array are left unchanged, every second bin from bin 65 to bin 192 is moved to bins 65 to 128, every second bin from bin 449 to bin 322 is moved to bins 449 to 386 and bins 129 to 385 are all multiplied by zero;

at step 40, the output of the transposition is transformed from the frequency domain to the time domain using a 512 point Inverse Fast Fourier Transform (IFFT);

at step 44, the output of the IFFT is windowed with a 512 taps Cosine window;

The output of the windowing block 44 is combined with its output of the previous cycle (256 samples ago) in block 46 using a 50% Overlap and Add method.

The digital samples resulting from this series of operations is turned into an analogue signal using a Digital to Analogue Converter (DAC) 48.

An output from the auxiliary signal processor 20 feeds the manipulated sound components to the primary signal processor 18. The primary signal processor 18 carries out conventional hearing aid compression and amplification processing. An output from the primary signal processor 18 feeds the sound delivery medium 16, which may be a normal hearing aid receiver.

Figure 4:
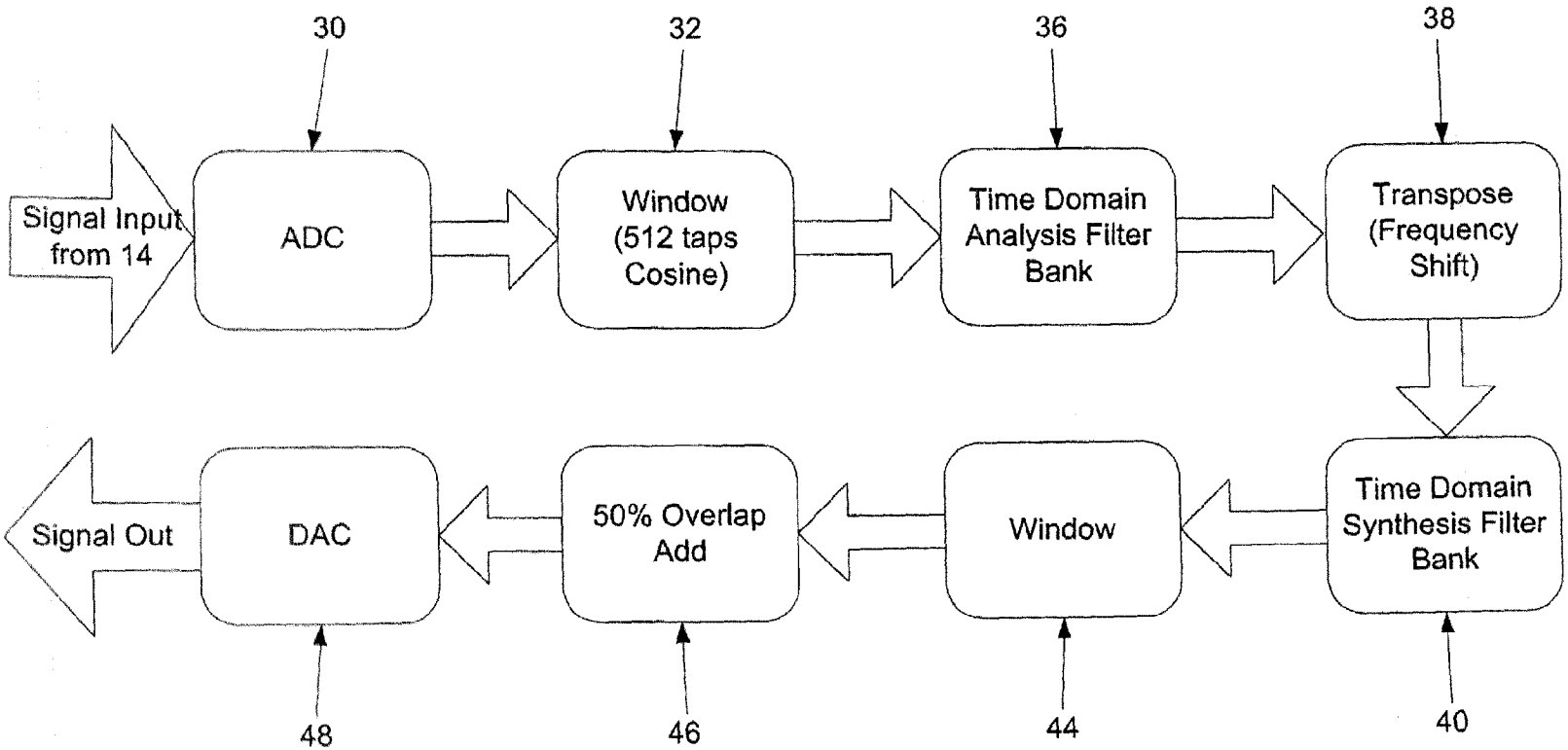
FIG. 4 shows a flow chart of a second embodiment of signal processing steps of an auxiliary signal processor of the equipment.

Referring now to FIG. 4 of the drawings, another version of effecting frequency manipulation of the high frequency components is shown. With reference to FIG. 2 of the drawings, like reference numerals refer to like parts unless otherwise specified.

In this embodiment, the frequency manipulation occurs in the time domain. Consequently, instead of the use of an FFT at step 36 and its IFFT at step 40, a time domain analysis filter bank is used at step 36 prior to the transposition step 38 and a time domain synthesis filter bank is used at a step 40 after the transposition step 38.

In yet a further embodiment of the invention, the auxiliary signal processor 20 divides the sound signal into a number of discrete frequency components and obtains frequency components $f_i$ above the speech frequency band for an output signal according to a mapping:

$$S(f_{n*i+c}) \rightarrow S(f_i),$$

where n is a positive integer and c is a constant integer.

Once again, those frequency components or bins outside the speech frequency band are frequency shied (transposed) by a transposition block as shown in FIG. 3 of the drawings.

Figure 5:
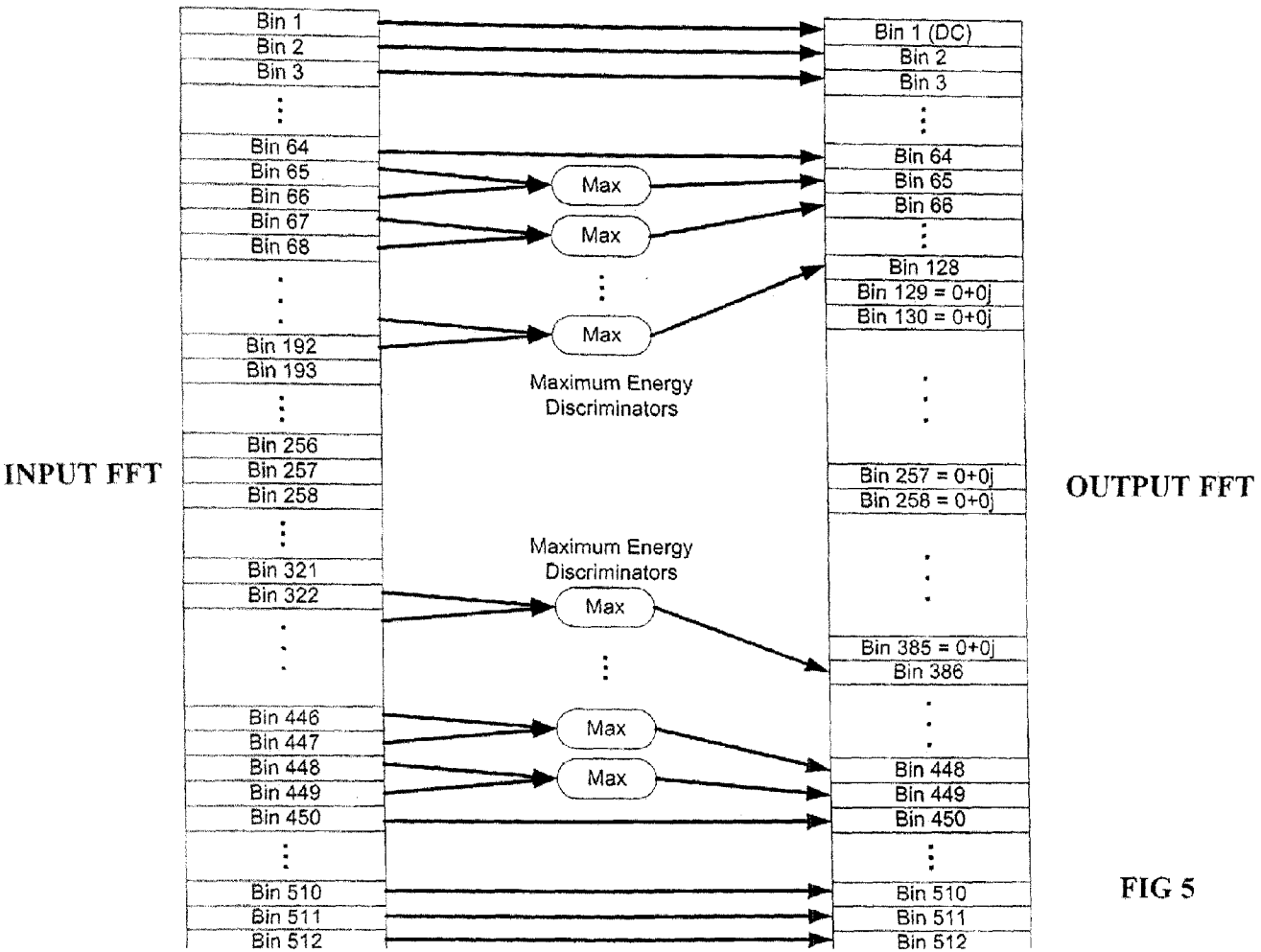
FIG. 5 shows another embodiment of a frequency transposition table for use in the auxiliary signal processor.

In still another embodiment of the invention, the auxiliary signal processor divides the sound signal into a number of discrete frequency components and obtains frequency components $f_i$ above the speech frequency band for an output signal according to a mapping:

$$S(f_{n*i+ci}) \rightarrow S(f_i),$$

where n is a positive integer and $c_i$ is adjusted for each i to select that frequency component with maximum energy out of frequency components $f_{n*i}$ to $f_{(n+1)*i-1}$. An example of a transposition table for this embodiment is shown in FIG. 5 of the drawings.

Figure 6:
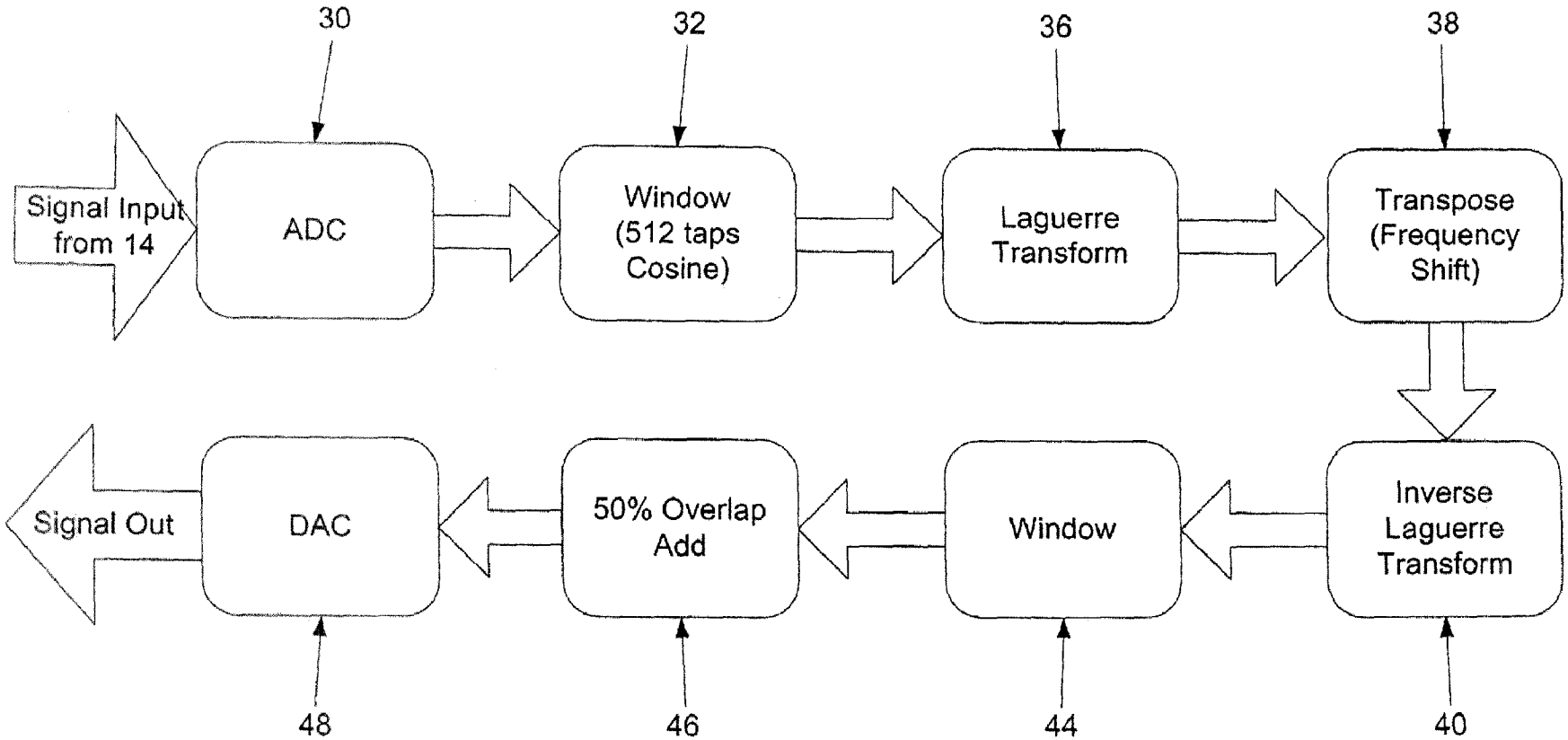
FIG. 6 shows a flow chart of a third embodiment of signal processing steps of an auxiliary signal processor of the equipment.

In yet a further embodiment of the invention, the auxiliary signal processor effects manipulation of the high frequency components by using a Laguerre Transform at step 36 instead of a FFT and, as a result, an Inverse Laguerre Transform at step 40 as shown in FIG. 6 of the drawings where, with reference to FIG. 2 of the drawings, like reference numerals refer to like parts unless otherwise specified.

The amplification of the previously high frequency sound components by the primary signal processor 18 is performed in such a manner so as to maintain a relative gain that is consistent as possible across the frequency components of the high frequency band.

In the embodiment of the invention where a listener wears two hearing aids, one in each ear, the amplification of the previously high frequency sound components by the primary signal processor 18 is also performed in such a manner that there is a relative gain that is as consistent as possible between the two ears for each frequency component within the high frequency band.

As indicated above, the conventional acoustic filtering provided by the outer ear of the listener is preserved by using a completely-in-the-canal housing 12 for the equipment 10. In the event that the listener has one unimpaired and one hearing impaired ear the listener can use the equipment 10 in the impaired ear with the unimpaired ear operating unassisted. Instead, in the case where the listener requires two hearing aids, each hearing aid can be implemented using the equipment 10.

Figure 7:
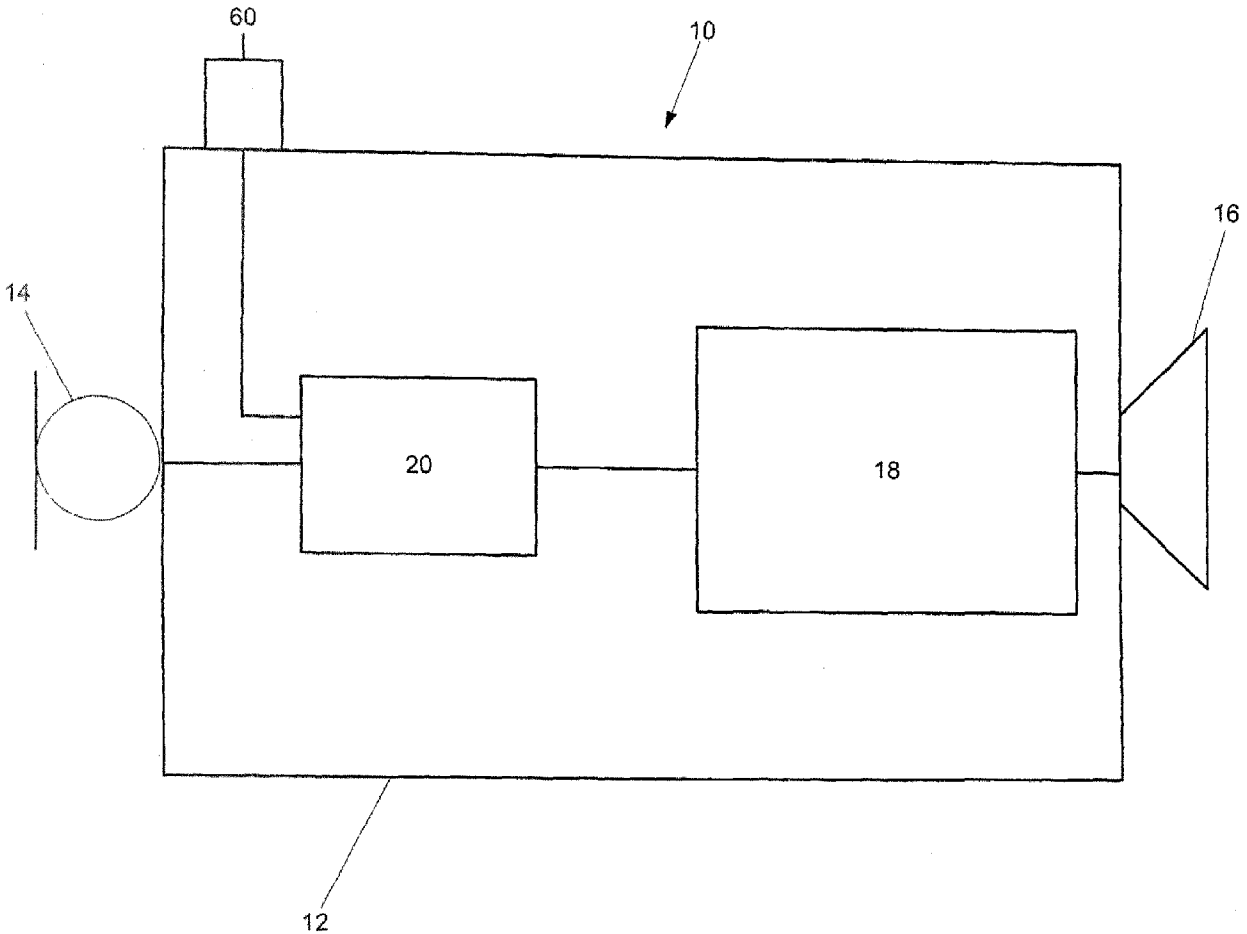
FIG. 7 shows a schematic block diagram of equipment, in accordance with a development of the invention, for enhancing sound heard by a hearing-impaired listener.

In a development of the invention, the equipment 10 can be provided with a communications receiver 60 (FIGS. 7 and 8) to enable the wearer to receive auxiliary audio signals to be rendered as virtual audio. As shown at step 31 the auxiliary audio signals are processed by a virtual auditory space rendering engine using the techniques described in PCT/AU01/00038 referenced above. The processing of the auxiliary audio signals using virtual audio space techniques creates an effect for the listener that the sound originate at specific locations in a personal auditory space around the listener's head. At step 33 the processed auxiliary audio signals are incorporated to produce, after the frequency manipulation steps 32, 36, 38, 40, 44 and 46, an output audio signal including a virtual audio component. The techniques to produce an output audio signal including a virtual audio component is described in the Applicants co-pending International Patent Application No. PCT/AU 2004/000902 filed 2 Jul. 2004 and entitled "The production of augmented reality audio." The contents of that International Patent Application are incorporated herein b reference.

Figure 8:
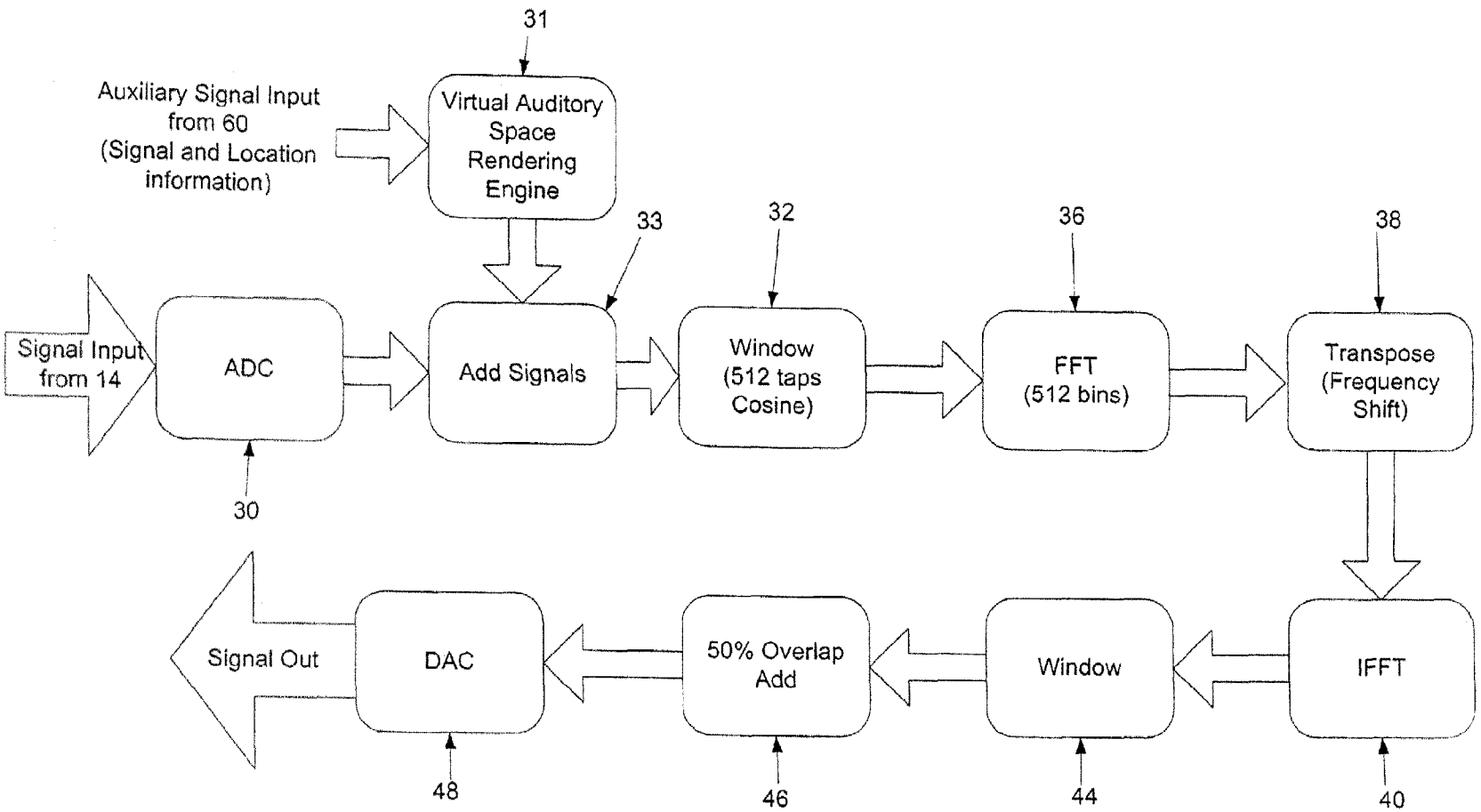
FIG. 8 shows a flow chart of signal processing steps for a auxiliary signal processor of the equipment of FIG. 7.

In the case of FIG. 8, with reference to FIG. 2 of the drawings, like reference numerals refer to like parts unless otherwise specified.

It is an advantage of the invention that the high frequency spectral cues that vary most with directions in space, i.e. those having frequencies above 8 kHz, are presented to a hearing impaired listener in an audible form. Because the auditory system has greater frequency resolution at the lower frequencies, the manipulation of the high frequency components to those lower frequencies assists in compensating for the hearing impaired listener's decreased frequency selectivity.

In addition, because the auditory system of the listener is capable of re-learning monaural spectral cues for sound spatialisation, the listener is able to learn to use the altered spectral cues that result from the manipulation of the high frequency components to lower frequencies. The length of time necessary to adapt to these new cues is comparable to the time normally required to become acclimatised to the wearing of conventional hearing aids.

Yet another advantage of the invention is that it restores some degree of spatial hearing to a hearing impaired listener which provides a basis for speech segregation in noisy acoustic environments. The equipment 10 enhances the segregation of multiple talkers from one another as well as from other background noises by using binaural and spectral cues related to the different locations of the sound sources. These spectral cues also give rise to a clearer perception of externalised sound sources which aids in information unmasking.

Yet a further advantage of the invention is that it provides a basis for locating the sources of a sound which aids in normal acoustic navigation.

Still another advantage of the invention is that it makes use of high frequency information provided by the fricatives and plosives of speech to aid in the spatialisation of the speech. In addition, the invention provides a means to optimise the utilisation of spatial information by the hearing-impaired listener by customising the high frequency band to the listener's optimal high frequency hearing range.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of enhancing sound heard by a hearing-impaired listener, the method comprising monitoring the sound in an environment in which the listener is located; and manipulating the frequency of high frequency components of the sound in a high frequency band while leaving the frequency of components of the sound in a speech frequency band unchanged, to enhance spectral cues to aid the listener in sound externalisation and spatialisation.

2. The method of claim 1 which includes manipulating the frequency of the high frequency components by a technique selected from the group comprising: compressing the components across a frequency range, shifting the high frequency components to lower frequencies and combinations of the foregoing.

3. The method of claim 1 which includes dividing the sound into a number of segments in time;

determining whether or not there are high frequency components of the sound in each of the segments; and manipulating the frequency of the high frequency components only for segments in which there is an occurrence of high frequency energy above a predetermined threshold in the high frequency band.

4. The method of claim 1 which includes dividing the sound into a number of segments in time;

determining whether or not the sound in each segment has a harmonic structure in the high frequency band; and manipulating the frequency of the high frequency components only for segments in which there is minimal harmonic structure in the high frequency band.

5. The method of claim 1 which is implemented in at least one hearing aid of the listener, the method further including configuring the hearing aid to preserve acoustic filtering of an outer ear of the listener.

6. The method of claim 1 which includes determining a hearing range for the listener and customising the manipulation of the high frequency components to the hearing range of the listener.

7. The method of claim 1 which includes manipulating the high frequency components by first transforming a sound signal to the frequency domain and, thereafter, modifying the frequency domain representation using one of a mapping and a warping technique.

8. The method of claim 1 which includes manipulating the high frequency components in the time-domain using at least one of a time-domain filter bank and a resampling technique to shift and/or compress the high frequency components to lower frequencies.

9. The method of claim 7 in which the mapping technique includes replacing frequency components in a range from $f_1$ to $f_2$ with frequency components in a second, lower range off $f_3$ to $f_4$ according to a mapping:

$$S\left(f_1 + (f - f_3)\frac{f_2 - f_1}{f_4 - f_3}\right) \rightarrow S(f), \text{ where } f_3 \le f \le f_4.$$

10. The method of claim 1 which includes, when effecting the manipulation of the high frequency components, at least partially preserving a harmonic relationship between the components.

11. The method of claim 1 which includes manipulating the high frequency components using a logarithmic compression technique.

12. The method of claim 7 which includes dividing the sound signal into a number of discrete frequency components and obtaining frequency components $f_i$ above the speech frequency band for an output signal according to a mapping:

$$S(f_{n*i+c}) \rightarrow S(f_i).$$

where n is a positive integer and c is a constant integer.

13. The method of claim 7 which includes dividing the sound signal into a number of discrete frequency components and obtaining frequency components $f_i$ above the speech frequency band for an output signal according to a mapping:

$$S(f_{n*i+c}) \rightarrow S(f_i).$$

where n is appositive integer and $c_i$ is adjusted for each ito select that frequency component with maximum energy out of frequency components $f_{n*i}$ to $f_{(n+1)*i-1}$.

14. The method of claim 7 which includes performing frequency transposition of the sound signal using a Laguerre transform.

15. The method of claim 1 which includes further manipulating the frequency of the high frequency components by signal amplification.

16. The method of claim 15 which includes applying the signal amplification so as to maintain consistent relative gain across frequency for the high frequency components.

17. The method of claim 15 which is implemented using a hearing aid in each ear of the listener, the method including applying the signal amplification so as to maintain consistent relative gain between the two ears for the high frequency band of each ear.

18. The method of claim 1 which includes changing the relative amplitude of each frequency component of the sound independently before and/or after manipulation of the high frequency components.

19. The method of claim 1 which includes enabling the listener to discontinue manipulation of the high frequency components.

20. The method of claim 1 which includes receiving auxiliary audio signals to be rendered as virtual audio; and incorporating the auxiliary audio signals to produce an output audio signal including a virtual audio component.

21. The method of claim 20 which includes processing the auxiliary audio signals using virtual audio space techniques to create an effect for the listener that the sound originate at specific locations in a personal auditory space around the listener's head.

22. Equipment for enhancing sound heard by a hearing-impaired listener, the equipment comprising at least one hearing aid device comprising:

a housing to be associated with an ear of the listener; a sensor associated with the housing for sensing the sound;

a delivery medium carried by the housing for delivering processed sound to an auditory system of the listener;

a primary signal processing arrangement contained within the housing, the primary signal processing arrangement being configured to perform conventional hearing aid signal processing;

and an auxiliary signal processing arrangement in communication with the primary signal processing arrangement, the auxiliary signal processing arrangement being configured to manipulate the frequency of the high frequency components while leaving components of the sound in a speech frequency band substantially unchanged to enhance spectral cues to aid the listener in sound externalisation and spatialisation.

23. The equipment of claim 22 which includes a listener operable interface for enabling the listener to disable the auxiliary signal processing arrangement.

24. The equipment of claim 22 which includes a discriminator in communication with the auxiliary signal processing arrangement, the discriminator discriminating between the frequencies of the components of the sounds and being operable to activate the auxiliary signal processing arrangement only for time windows in which there is an occurrence of high frequency energy above a predetermined threshold in the high frequency band.

25. The equipment of claim 22 in which the housing is configured to minimally disrupt acoustic filtering of an outer ear of the listener.

26. The equipment of claim 22 in which the auxiliary signal processing arrangement manipulates the high frequency components by at least one of compressing the high frequency components across a frequency range and shifting the high frequency to lower frequencies.

27. The equipment of claim 26 in which at least one of the primary signal processing arrangement and the auxiliary signal processing arrangement is further operable to manipulate the high frequency components by signal amplification.

28. The equipment of claim 22 in which the auxiliary signal processing arrangement is interposed between the primary signal processing arrangement and the sensor.

29. The equipment of claim 22 which includes two hearing aid devices, one for each ear of the listener.

30. The equipment of claim 29 in which the signal processing arrangements of each of the hearing aid devices are operable to amplify the high frequency sound components so as to maintain consistent gain between the two ears of the listener for each high frequency band.

31. The equipment of claim 22 which includes a communications receiver in communication with the primary signal processing arrangement, the receiver receiving auxiliary audio signals to be rendered as virtual audio to produce an output audio signal including a virtual audio component.

32. The equipment of claim 31 in which the primary processing arrangement is operable to process the auxiliary audio signals using virtual audio space techniques to create an effect for the listener that the sound originates at specific locations in a personal auditory space around the listener's head.

* * * * *